US010790567B2

(12) United States Patent
Pilla et al.

(10) Patent No.: US 10,790,567 B2
(45) Date of Patent: Sep. 29, 2020

(54) ENHANCED AIR CORE TRANSMISSION LINES AND TRANSFORMERS

(71) Applicant: Qorvo US, Inc., Greensboro, NC (US)

(72) Inventors: Subrahmanyam V. Pilla, Plano, TX (US); John Hitt, Plano, TX (US); Michael Roberg, Evergreen, CO (US)

(73) Assignee: Qorvo US, Inc., Greensboro, NC (US)

( * ) Notice: Subject to any disclaimer, the term of this patent is extended or adjusted under 35 U.S.C. 154(b) by 0 days.

(21) Appl. No.: 16/278,353

(22) Filed: Feb. 18, 2019

(65) Prior Publication Data

US 2020/0266513 A1 Aug. 20, 2020

(51) Int. Cl.

| | |
|---|---|
| ***H01P 1/30*** | (2006.01) |
| ***H01P 3/08*** | (2006.01) |
| ***H01P 11/00*** | (2006.01) |
| ***H01F 41/04*** | (2006.01) |
| ***H01F 17/00*** | (2006.01) |
| ***H01F 17/02*** | (2006.01) |
| ***H01F 19/04*** | (2006.01) |

(52) U.S. Cl.

CPC ..... *H01P 1/30* (2013.01); *H01F 17/0013* (2013.01); *H01F 17/02* (2013.01); *H01F 19/04* (2013.01); *H01F 41/041* (2013.01); *H01P 3/084* (2013.01); *H01P 11/003* (2013.01)

(58) Field of Classification Search

CPC ..... H01L 2223/6627; H01L 23/5225; H01L 2924/1903; H01P 3/081; H01P 3/084; H01P 5/187; H01P 1/30

See application file for complete search history.

(56) References Cited

U.S. PATENT DOCUMENTS

| | | | | |
|---|---|---|---|---|
| 5,594,393 | A * | 1/1997 | Bischof | H01P 3/026 333/128 |
| 5,907,266 | A * | 5/1999 | Budka | H01P 1/2135 333/116 |
| 6,466,112 | B1 * | 10/2002 | Kwon | H01L 23/5225 333/238 |
| 8,164,397 | B2 * | 4/2012 | Wang | H01P 3/081 333/238 |
| 9,406,604 | B2 * | 8/2016 | Cho | H01L 23/5223 |
| 9,406,621 | B2 * | 8/2016 | Mitchell | H01L 23/552 |
| 10,122,328 | B2 * | 11/2018 | Roberg | H03F 1/565 |
| 10,257,921 | B1 * | 4/2019 | Roy | H01P 3/087 |

* cited by examiner

*Primary Examiner* — Dean O Takaoka

*Assistant Examiner* — Alan Wong

(74) *Attorney, Agent, or Firm* — Withrow & Terranova, P.L.L.C.

(57) ABSTRACT

Enhanced air core transmission lines and transformers are disclosed. A transmission line or transformer is disposed on a dielectric substrate, with a first planar conductor on the dielectric substrate and a second planar conductor suspended above the first planar conductor. A set of support posts suspends the second planar conductor above the first planar conductor. Thermal performance of the transmission line or transformer is improved by having each of the set of support posts include a width which exceeds any gap between support posts. In some examples, openings are formed in the second planar conductor and may facilitate etching or other processes of forming the transmission line or transformer.

20 Claims, 10 Drawing Sheets

ENHANCED AIR CORE TRANSMISSION LINES AND TRANSFORMERS

FIELD OF THE DISCLOSURE

The present disclosure relates to radio frequency (RF) impedance transmission lines and transformers having planar conductors in a coupled configuration.

BACKGROUND

Transformers are an important component used in radio frequency (RF) circuitry. They can be used in filter circuits, in impedance matching circuits, and in transforming balanced to unbalanced (balun) circuits. Lower RF applications (low hundreds of megahertz (MHz)) traditionally use windings on a ferrite core, with the square of the ratio of primary to secondary windings $(Np/Ns)^2$ representing an impedance ratio (Zp/Zs). Power is transferred through the ferrite core. Higher RF applications (high hundreds of MHz to gigahertz (GHz)) often incorporate transmission line transformers that are constructed from planar conductors arranged on dielectric substrates. Power is generally transferred through the dielectric medium of the transmission line. Characteristic impedance of the transmission line is critical in obtaining a most efficient power transfer performance for the transformer. However, traditional transmission lines suffer from dielectric losses that limit their bandwidth at higher frequencies. Moreover, traditional transmission line geometries do not extend efficient power transmission at lower frequencies in the MHz range.

FIG. 1A is a topside view of a previously proposed transformer configuration implemented using a broadside-coupled transformer 10 to overcome limitations of traditional approaches. The broadside-coupled transformer 10 includes a bottom electrode 12 and a top electrode 14 arranged over a substrate 16 in an elongated U-shaped pattern. The bottom electrode 12 is disposed on the substrate 16. The top electrode 14 is held in position over and spaced apart from the bottom electrode 12 by stakes 18.

FIG. 1B is a perspective view of an end section of the broadside-coupled transformer 10 of FIG. 1A. FIGS. 1A and 1B viewed together show the bottom electrode 12 disposed on the substrate 16 with the top electrode 14 supported over the bottom electrode 12 by way of the stakes 18. Each of the stakes 18 has a bottom attached to the substrate 16 without contacting the bottom electrode 12 and a top attached to a surface of the top electrode 14 to support the top electrode 14 over the bottom electrode 12 such that the top electrode 14 is positioned over and spaced apart from the bottom electrode 12. A total number of the stakes 18 needed to support the top electrode 14 over the bottom electrode 12 can depend on the dimensions of the top electrode 14 and the material out of which the top electrode 14 is made. For example, the broadside-coupled transformer 10 depicted in FIGS. 1A and 1B can have a width across a side S1 of 47 microns (μm) and a thickness of 4 μm. Based on these criteria, the number of stakes 18 used is forty (40), with the stakes 18 being substantially evenly and widely spaced (e.g., having a gap between the stakes 18 much larger than a width of each stake 18).

However, thermal performance of the broadside-coupled transformer 10 of FIGS. 1A and 1B can be limited due to low thermal coupling from the relatively small and widely spaced stakes 18. FIGS. 2A and 2B show thermal diagrams of a circuit 20 incorporating the broadside-coupled transformer 10 of FIG. 1A. FIG. 2A shows the circuit 20 without power, and FIG. 2B shows the circuit 20 with an input power of 27 decibel-milliwatts (dBm). As illustrated, even at the modest input power of 27 dBm, a temperature of the top electrode 12 may rise well above a temperature of the substrate 16.

SUMMARY

Enhanced air core transmission lines and transformers are disclosed. The transmission lines and transformers are generally used in radio frequency (RF) circuitry, such as filter circuits, impedance matching circuits, and in balanced to unbalanced (balun) circuits. These transmission lines and transformers may be referred to generally as an impedance transmission line. An impedance transmission line is disposed on a dielectric substrate, with a first planar conductor on the dielectric substrate and a second planar conductor suspended above the first planar conductor. A set of support posts suspends the second planar conductor above the first planar conductor. Thermal performance of the transmission line or transformer is improved by having each of the set of support posts include a width which exceeds any gap between support posts. In some examples, openings are formed in the second planar conductor and may facilitate etching or other processes of forming the transmission line or transformer.

An exemplary aspect of the disclosure provides an impedance transmission line. The impedance transmission line includes a dielectric substrate and a first planar conductor disposed on the dielectric substrate. The impedance transmission line also includes a second planar conductor positioned over and spaced apart from the first planar conductor, the second planar conductor having a first edge and a second edge opposite the first edge. The impedance transmission line also includes a plurality of support posts, each support post thermally coupling the first edge or the second edge of the second planar conductor to the dielectric substrate. Each of the plurality of support posts has a width defined along the first edge or the second edge of the second planar conductor which exceeds any gap between adjacent support posts.

In another aspect, a method of forming an impedance transmission line is provided. The method includes forming a first planar conductor having a first edge and a second edge on a dielectric substrate. The method also includes forming a first set of support posts on the dielectric substrate along and separated from the first edge. The method also includes forming a second set of support posts on the dielectric substrate along and separated from the second edge. The method also includes forming a second planar conductor on the first and second sets of support posts. The second planar conductor defines a plurality of openings positioned between the first set of support posts and the second set of support posts.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
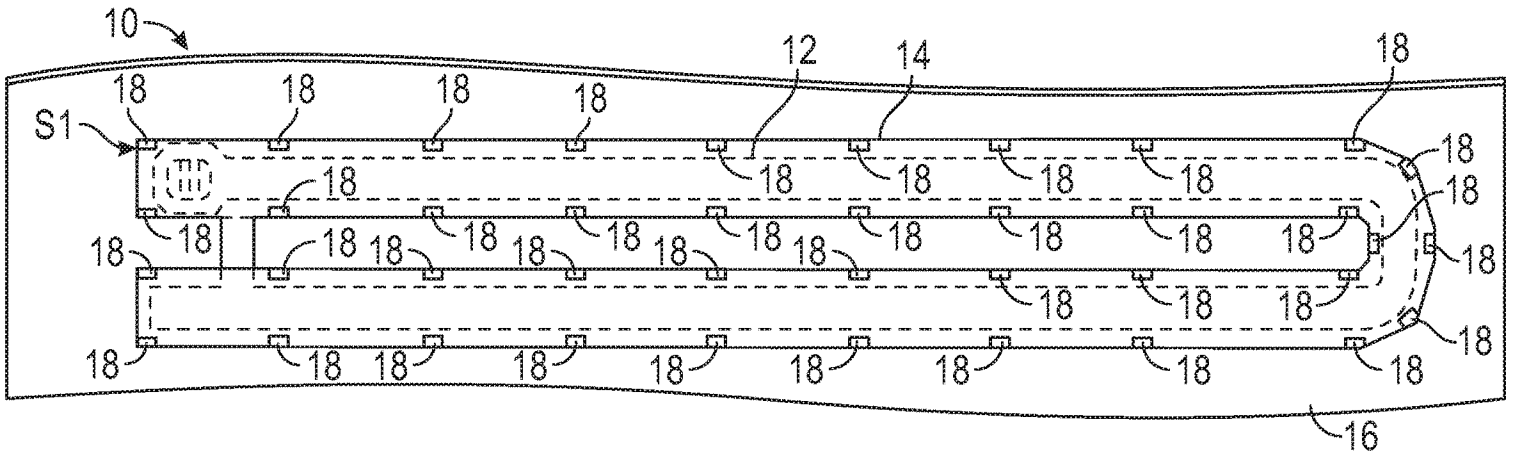
FIG. 1A (Prior Art)
FIG. 1A is a topside view of a previously proposed transformer configuration implemented using a broadside-coupled transformer.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Enhanced air core transmission lines and transformers are disclosed. The transmission lines and transformers are generally used in radio frequency (RF) circuitry, such as filter circuits, impedance matching circuits, and in balanced to unbalanced (balun) circuits. These transmission lines and transformers may be referred to generally as an impedance transmission line. An impedance transmission line is disposed on a dielectric substrate, with a first planar conductor on the dielectric substrate and a second planar conductor suspended above the first planar conductor. A set of support posts suspends the second planar conductor above the first planar conductor. Thermal performance of the transmission line or transformer is improved by having each of the set of support posts include a width which exceeds any gap between support posts. In some examples, openings are formed in the second planar conductor and may facilitate etching or other processes of forming the transmission line or transformer.

To assist in understanding aspects of the present disclosure, an exemplary impedance transmission line, which may be an enhanced air core transmission line or transformer, is described below with respect to FIGS. 3A, 3B, and 4. A process of forming the exemplary impedance transmission line is described below with respect to FIG. 5. Performance of the exemplary impedance transmission line is described below with respect to FIGS. 6 and 7. Exemplary impedance transformation circuitry that includes the exemplary impedance transmission line is described below with respect to FIGS. 8 and 9.

Figure 3A:
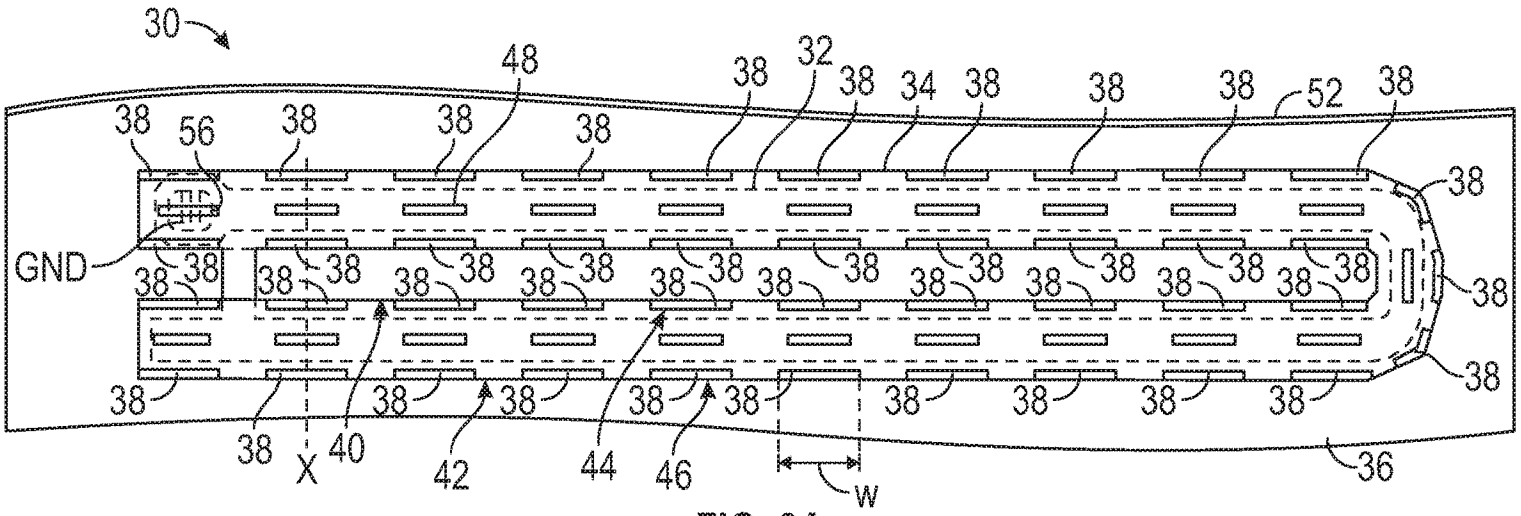
FIG. 3A is a topside view of an exemplary impedance transmission line which may be an enhanced air core transmission line or transformer.

In this regard, FIG. 3A is a topside view of an exemplary impedance transmission line 30 which may be an enhanced air core transmission line or transformer. The impedance transmission line 30 includes a first planar conductor 32, which may be coupled to a fixed voltage node (e.g., RF ground GND). A second planar conductor 34 may be coupled to a RF signal input RFIN and an RF signal output RFOUT. The first planar conductor 32 and the second planar conductor 34 are arranged over a dielectric substrate 36. In the example depicted in FIG. 3A, each of the first planar conductor 32 and the second planar conductor 34 have an elongated U-shaped pattern. In other examples, the first planar conductor 32 and the second planar conductor 34 of the impedance transmission line 30 may be formed in another geometric shape.

The first planar conductor 32 is disposed on the dielectric substrate 36. The second planar conductor 34 is positioned over and spaced apart from the first planar conductor 32 by support posts 38. The second planar conductor 34 has a first edge 40 and an opposite second edge 42. Each support post couples the first edge 40 or the second edge 42 to the dielectric substrate 36. For example, a first set of support posts 44 may be coupled to the first edge 40, while a second set of support posts 46 is coupled to the second edge 42. Generally, the first planar conductor 32 and the second planar conductor 34 are oblong (e.g., a first length of the first edge 40 and a second length of the second edge 42 of the second planar conductor 34 exceed a width between the first edge 40 and the second edge 42). In some cases, the first edge 40 and the second edge 42 may be parallel to one another and form elongated edges of the elongated U-shaped pattern of the second planar conductor 34. In other cases, the first edge 40 and the second edge 42 may be non-parallel opposing edges of the second planar conductor 34.

Figure 1B:
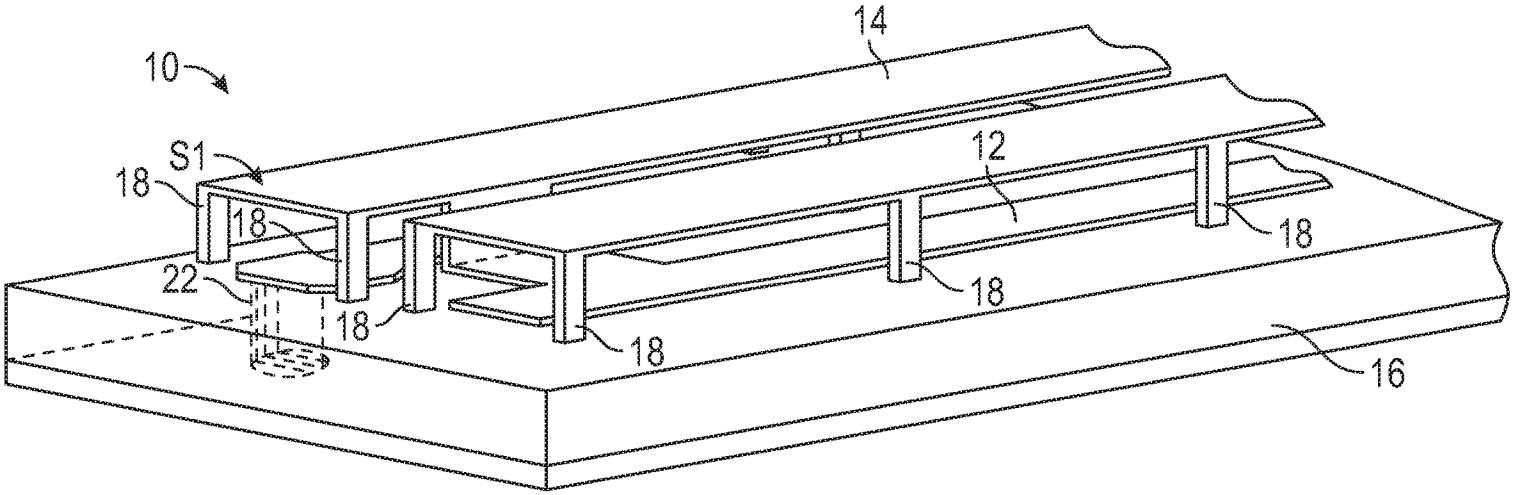
FIG. 1B (Prior Art)
FIG. 1B is a perspective view of an end section of the broadside-coupled transformer of FIG. 1A.
Figure 2A:
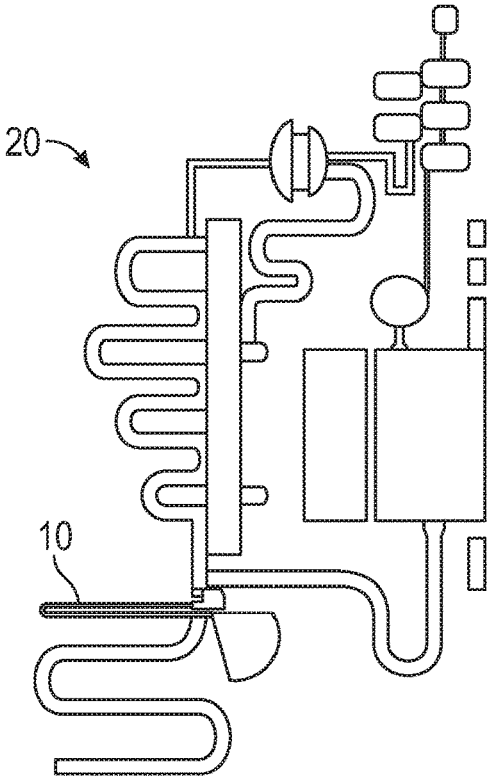
FIGS. 2A and 2B show thermal diagrams of a circuit incorporating the broadside-coupled transformer of FIG. 1A.
Figure 2B:
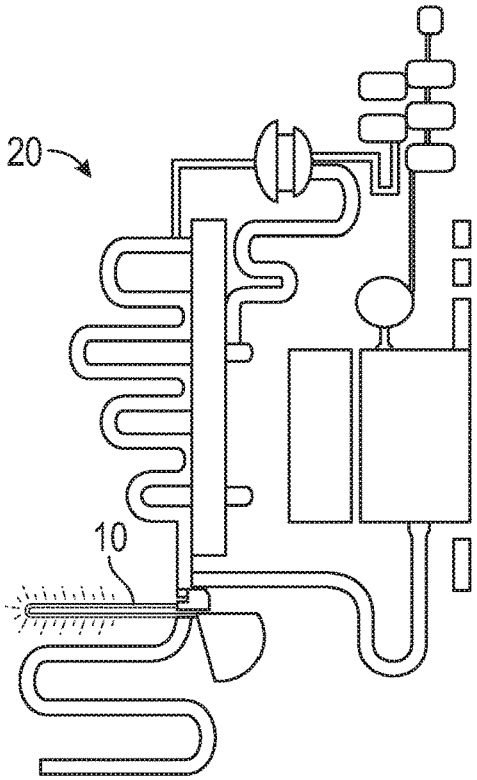

In contrast to the narrow and widely spaced stakes 18 of the broadside-coupled transformer 10 of FIGS. 1A and 1B, the support posts 38 are wide and narrowly spaced. That is, a width W of each support post 38 is defined along the first edge 40 or the second edge 42, and the width W exceeds a gap between adjacent support posts 38. In this manner, the second planar conductor 34 can more efficiently transfer heat with the dielectric substrate 36. Thus, the support posts 38 thermally couple the second planar conductor 34 to the dielectric substrate 36 to improve overall performance of the impedance transmission line 30. In another exemplary aspect, the second planar conductor 34 defines a plurality of openings 48 in its planar surface over the first planar conductor 32.

Figure 3B:
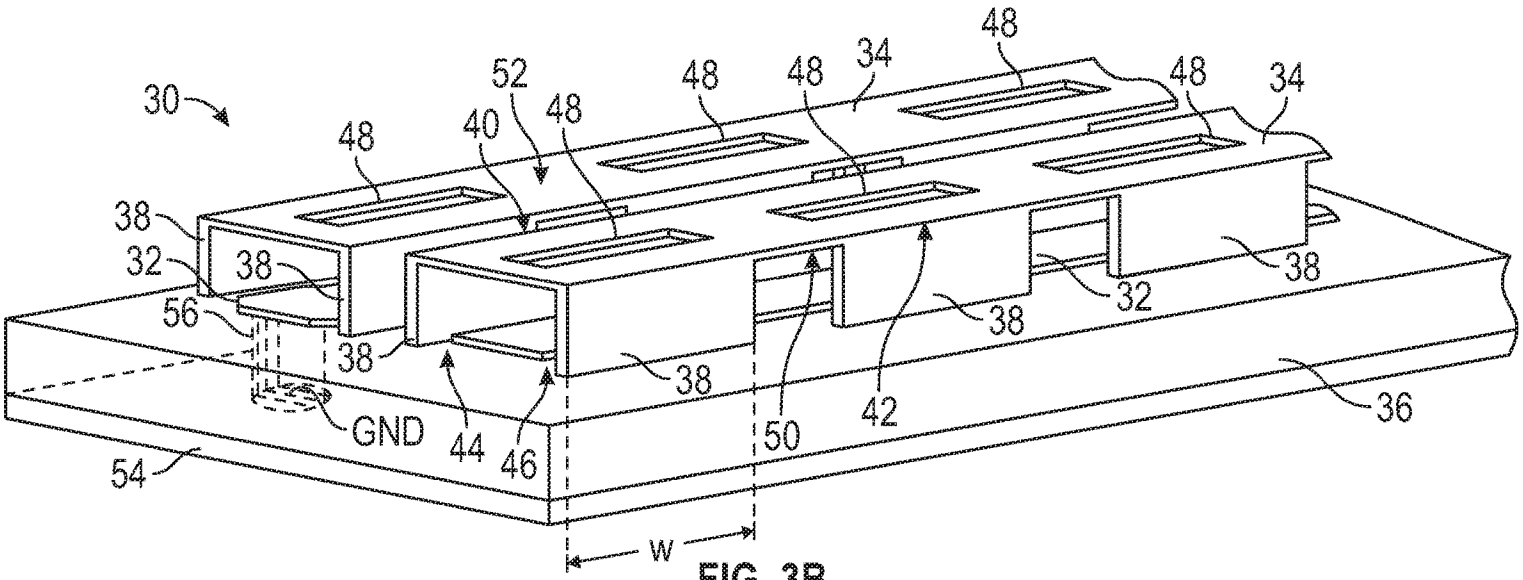
FIG. 3B is a perspective view of an end section of the impedance transmission line of FIG. 3A showing a first planar conductor disposed on a dielectric substrate and a second planar conductor supported over the first planar conductor by way of support posts.

FIG. 3B is a perspective view of an end section of the impedance transmission line 30 of FIG. 3A. Together, FIGS. 3A and 3B show the first planar conductor 32 disposed on the dielectric substrate 36 and the second planar conductor 34 supported over the first planar conductor 32 by way of the support posts 38. Each of the support posts 38 has a bottom attached to the dielectric substrate 36 without contacting the first planar conductor 32 and a top attached to either the first edge 40 or the second edge 42 of the second planar conductor 34. The support posts 38 support the second planar conductor 34 over the first planar conductor 32 such that the second planar conductor 34 is positioned over and spaced apart from the first planar conductor 32.

In the exemplary embodiment depicted in FIGS. 3A and 3B, the top of each of the support posts 38 is formed integral with the second planar conductor 34 (e.g., integral with the first edge 40 or the second edge 42, respectively). It should be understood that the support posts 38 can be integral with or otherwise attached to other portions of the second planar conductor 34, such as a bottom surface 50. In addition, in the exemplary impedance transmission line 30, the first set of support posts 44 coupled to the first edge 40 and the second set of support posts 46 coupled to the second edge 42 each include multiple support posts 38. In some examples, multiple support posts 38 can be coupled to the first edge 40 and an additional support post 38 can be coupled to the second edge 42 and span a continuous distance of the second edge 42 (or vice versa). In some examples, one support post 38 can span a continuous distance of the first edge 40 and another support post 38 can span a continuous distance of the second edge 42.

The openings 48 formed in the second planar conductor 34 can be oblong openings which span parallel to the first edge 40 and the second edge 42, and may be positioned (e.g., centered) between a respective one of the first set of support posts 44 and one of the second set of support posts 46. The openings 48 are illustrated as rectangular in shape, but may be another oblong shape, such as an oval, a capsule, or another geometric shape. In addition, each opening 48 is depicted as being centered with one of the support posts 38 along its elongated length, but this is not required. For example, two or more openings 48 may be positioned side by side between the support posts 38. Generally, the openings 48 are formed at regular intervals along a length of the second planar conductor 34, but may be formed at irregular intervals as well.

Space between the first planar conductor 32 and the second planar conductor 34 can be filled with a vacuum or air. In this case, the bottom surface 50 of the second planar conductor 34 is not directly in contact with a solid dielectric. Additionally, a top surface 52 of the second planar conductor 34 may not be directly in contact with a solid dielectric. In alternative embodiments, the space between the first planar conductor 32 and the second planar conductor 34 can be fully or partially occupied by other dielectric materials.

As shown in FIGS. 3A and 3B, a backside of the dielectric substrate 36 (e.g., opposite the side to which the impedance transmission line 30 is attached) has a conductive ground plane 54 disposed thereon. A conductive via 56 couples the second planar conductor 34 to ground GND provided by the ground plane 54.

Figure 4:
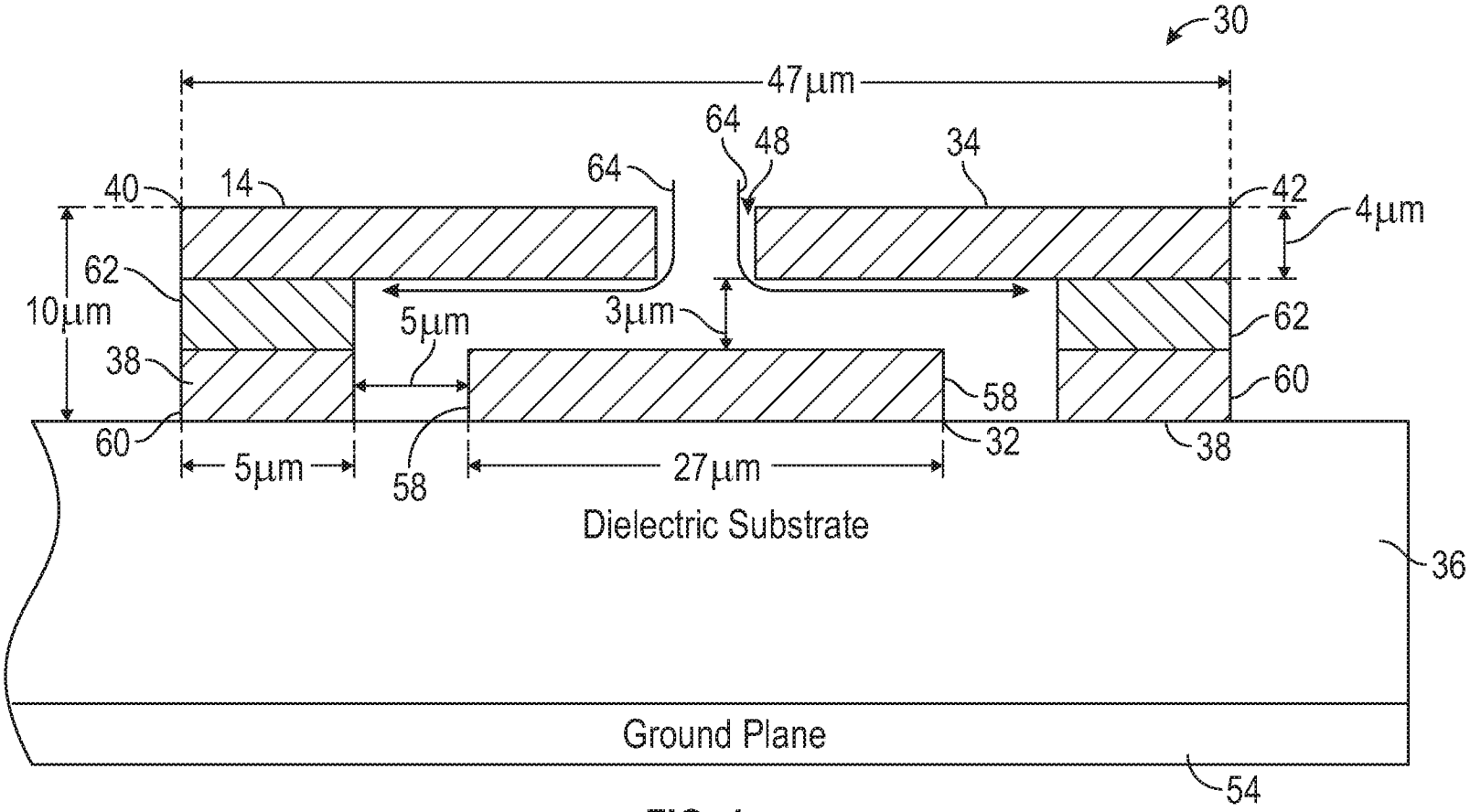
FIG. 4 is a cross-sectional view of the impedance transmission line of FIG. 3A taken along line X, showing exemplary dimensions for the first planar conductor, the second planar conductor, and other elements of the impedance transmission line.

FIG. 4 is a cross-sectional view of the impedance transmission line 30 of FIG. 3A taken along line X, showing exemplary dimensions for the first planar conductor 32, the second planar conductor 34, and other elements of the impedance transmission line. In an exemplary aspect, the first planar conductor 32 and the second planar conductor 34 each have a thickness that is greater than 2 microns (μm) and less than 6 μm, and in the specific example of FIG. 4, the thickness of the first planar conductor 32 is 3 μm and the thickness of the second planar conductor 34 is 4 μm. The support posts 38 are rectangular prisms with a thickness as seen in FIG. 4 of 5 μm, a height of 10 μm, and the width W as seen in FIGS. 3A and 3B of greater than 10 μm. As such, the first planar conductor 32 and the second planar conductor 34 are spaced apart by 3 μm.

Generally, the width W of the support posts 38 is greater than a gap between adjacent support posts 38. In the exemplary impedance transmission line 30, the width W of the support posts 38 is 50 μm, but the width W and the gap between adjacent support posts 38 can be adjusted according to a desired thermal performance. The bottom of each support post 38 is spaced from sidewalls 58 of the first planar conductor 32 by 5 μm. The width of the first planar conductor 32 defined between sidewalls 58 is 27 μm. The width of the second planar conductor 34 defined between the first edge 40 and the second edge 42 is 47 μm. Generally, the width of the second planar conductor 34 will be at least 20 μm wider than the first planar conductor 32 to accommodate the support posts 38 and the gap between the first planar conductor 32 and the support posts 38.

The first planar conductor 32 typically has a width that is from 10 μm to 100 μm. Moreover, the support posts 38 are separated and spaced from the sidewalls 58 of the first planar conductor 32 by at least 2 μm. However, it is to be understood that the dimensions illustrated in FIG. 4 are exemplary only and that the dimensions are determined based upon given RF bandwidth specifications and desired loss characteristics. For example, the above dimensions are for a 4-mil silicon carbide (SiC) substrate, but the above dimensions would typically be different for a different substrate thickness of the same substrate material, or a different substrate material of the same thickness. In this regard, the width of the second planar conductor 34 defined between the first edge 40 and the second edge 42 can range from 30 μm to 250 μm. Moreover, the support posts 38 are not constrained to having rectangular prism shapes. The support posts 38 can be rounded or have other geometric shapes having a larger width W than the thickness or a gap between the support posts 38.

In an exemplary embodiment, the first planar conductor 32, the second planar conductor 34, the support posts 38, the via 56, and the ground plane 54 are made of metal, such as gold, copper, aluminum, steel, a combination thereof, and so on. In other examples the first planar conductor 32, the second planar conductor 34, the support posts 38, the via 56, and the ground plane 54 are made of other conductive materials or materials coated or plated in a metal. The dielectric substrate 36 is made of an appropriate dielectric, such as silicon carbide (SiC) or silicon (Si).

In an exemplary aspect, the first planar conductor 32, the second planar conductor 34, and the support posts 38 are deposited on the dielectric substrate 36 through a multi-layer deposition technique. For example, the first planar conductor 32 and a bottom section 60 of the support posts 38 may be deposited in a first layer. A middle section 62 of the support posts 38 may be deposited in a second layer, and the second planar conductor 34 may be deposited in a third layer. In this regard, a mask, such as a photoresist layer, may be applied to direct deposition of the first planar conductor 32, the second planar conductor 34, and the support posts 38. The mask may be a photoresist layer or other appropriate masking material, and may be etched or otherwise cleaned out once the first planar conductor 32, the second planar conductor 34, and the support posts 38 are deposited.

In this regard, due to the small gap between adjacent support posts 38, the mask may not be efficiently etched, which would degrade performance of the impedance transmission line 30. In this regard, the openings 48 are formed in the second planar conductor 34 to facilitate etching the mask by allowing flow 64 of gases through the impedance transmission line 30. This enables more efficient etching of the mask, improving the performance of the impedance transmission line 30. As described above, the openings 48 are oblong, with an elongated length spanning parallel to the first edge 40 and the second edge 42. In the example depicted in FIG. 4, the elongated length of the openings 48 is 4 μm shorter than the width W of the support posts 38 (e.g., 46 μm), and a width of the openings 48 is 5 μm wide. It should be understood that the dimensions of the openings 48 will vary according to other dimensions of the impedance transmission line 30 and the material of the mask.

Figure 5:
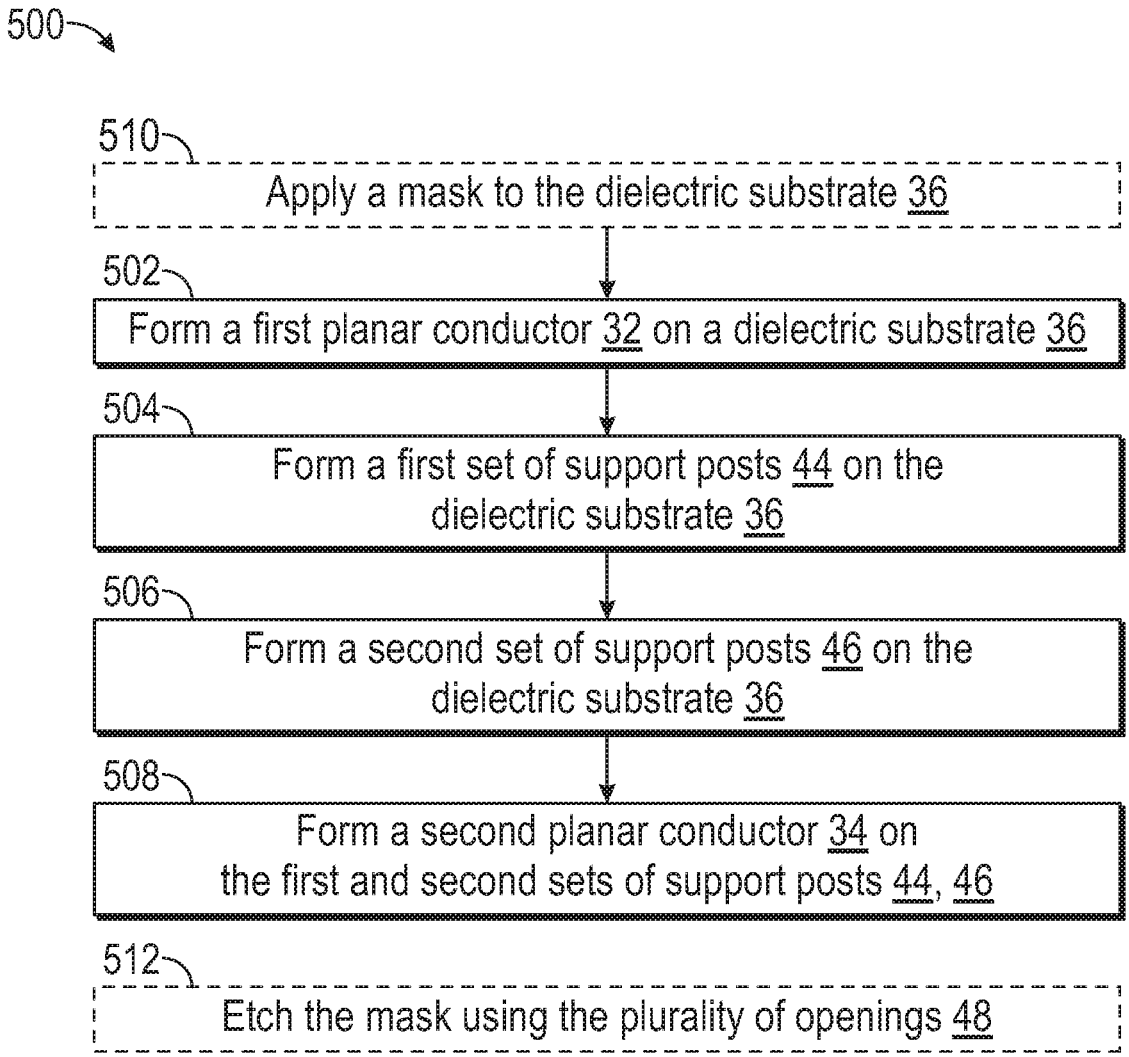
FIG. 5 is a flow diagram for a process of forming the exemplary impedance transmission line of FIG. 3A.

FIG. 5 is a flow diagram for a process 500 of forming the exemplary impedance transmission line 30 of FIG. 3A. With continuing reference to FIGS. 3A, 3B, and 4, the process 500 includes forming the first planar conductor 32 (which has the first edge 40 and the second edge 42) on the dielectric substrate 36 (block 502). The process 500 also includes forming a first set of support posts 44 on the dielectric substrate 36 along and separated from the first edge 40 (block 504). The process 500 also includes forming a second set of support posts 46 on the dielectric substrate 36 along and separated from the second edge 42 (block 506). The process 500 also includes forming a second planar conductor 34 on the first and second sets of support posts 44, 46, the second planar conductor 34 defining the plurality of openings 48 positioned between the first set of support posts 44 and the second set of support posts 46 (block 508).

It should be understood that the operations of the process 500 may be performed in different orders than depicted in FIG. 5, and at least some operations may be performed concurrently. For example, forming the first set of support posts 44 (block 504) and forming the second set of support posts 46 (block 506) may be performed concurrently, and may be partially performed concurrent with forming the first planar conductor 32 (block 502). In some examples, the process 500 may also include applying a mask to the dielectric substrate 36 before forming the first planar conductor 32 (block 510). The process 500 may also include etching the mask using the plurality of openings 48 (block 512).

Figure 6:
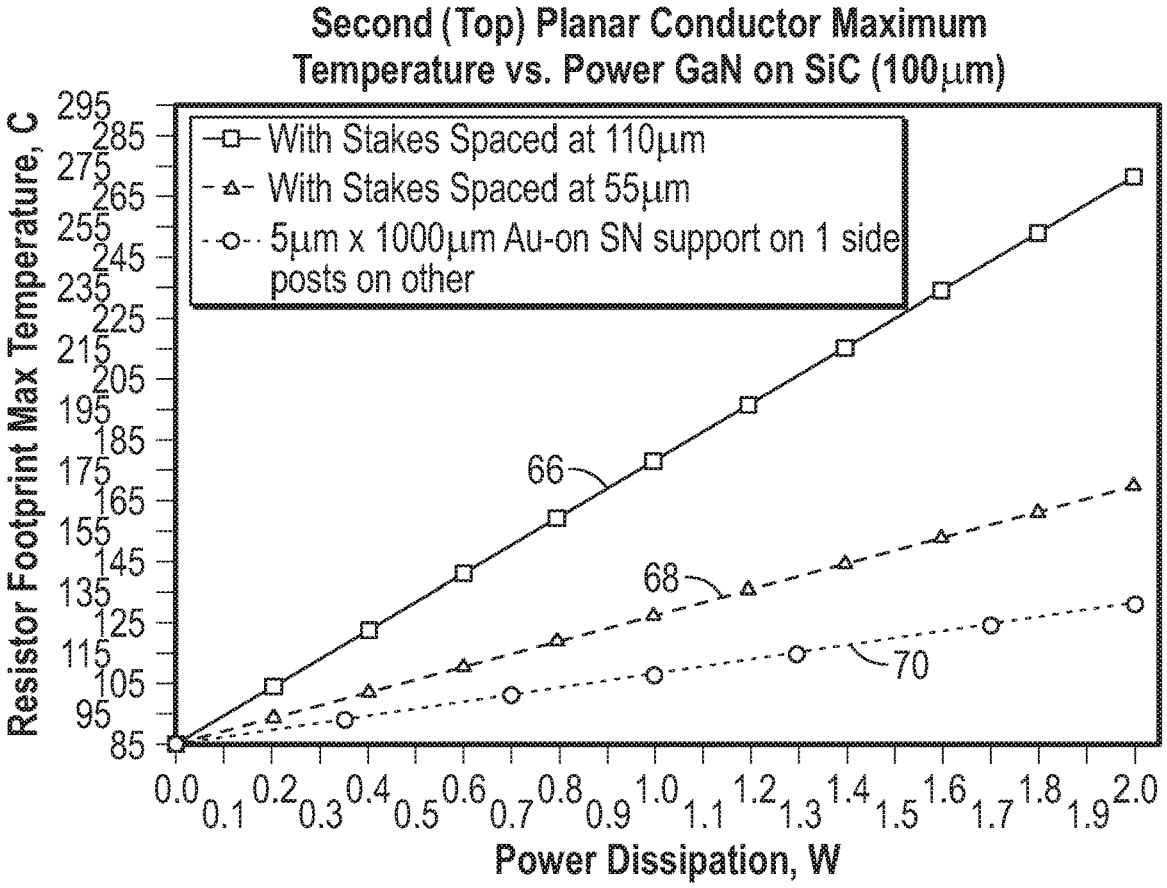
FIG. 6 is a graphical illustration of a thermal model of the impedance transmission line of FIG. 3A and the broadside-coupled transformer of FIGS. 1A and 1B, showing improved thermal efficiency.

FIG. 6 is a graphical illustration of a thermal model of the impedance transmission line 30 of FIG. 3A and the broadside-coupled transformer 10 of FIGS. 1A and 1B, showing improved thermal efficiency. A first plot 66 and a second plot 68 of the thermal model illustrate thermal performance of the broadside-coupled transformer 10 of FIGS. 1A and 1B having stakes 18 spaced at 110 μm and 55 μm, respectively. As an example, a third plot 70 of the thermal model illustrates thermal performance of the impedance transmission line 30 with the first edge 40 of the second planar conductor 34 fully supported by a support post 38 (e.g., one support post 38 spans a continuous distance of the first edge 40). The third plot 70 indicates a substantial improvement in the thermal handling capacity of the impedance transmission line 30 over the broadside-coupled transformer 10 of FIGS. 1A and 1B. Greater improvements in the thermal handling capacity of the impedance transmission line 30 can be achieved through wide support posts 38 having the first set of support posts 44 coupled to the first edge 40 and the second set of support posts 46 coupled to the second edge 42.

Figure 7:
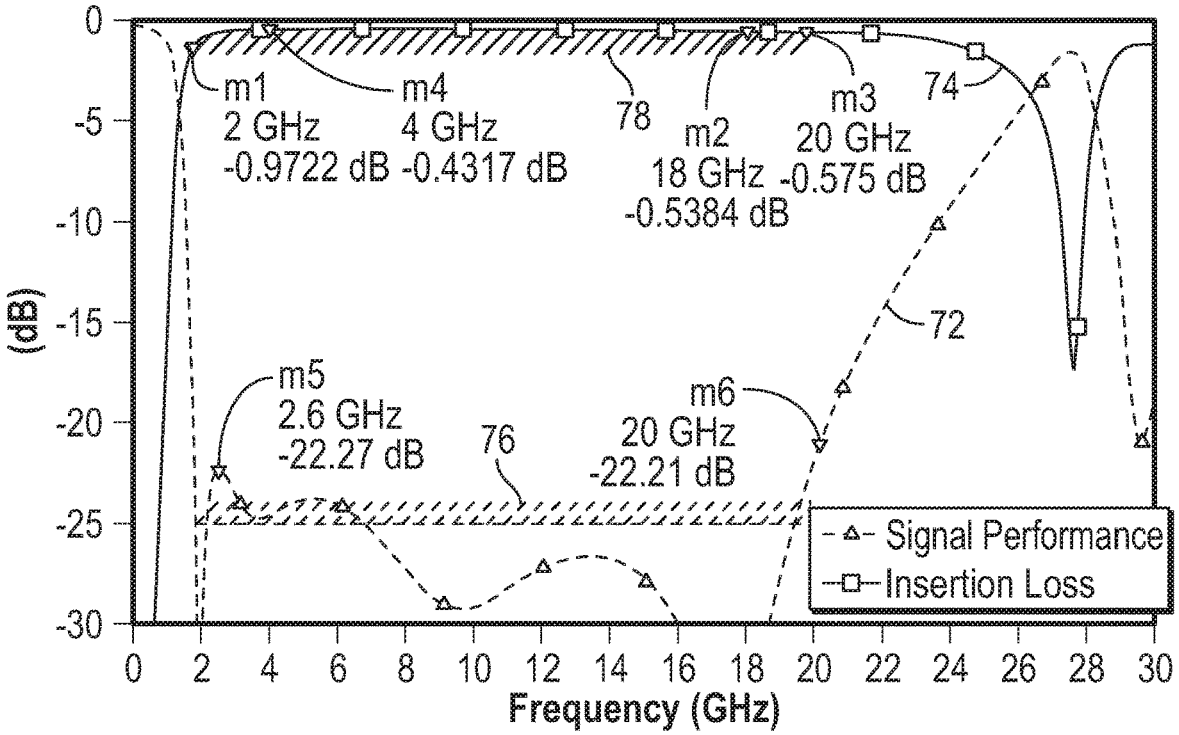
FIG. 7 is a graphical illustration of a small signal model of the impedance transmission line of FIG. 3A.

FIG. 7 is a graphical illustration of a small signal model of the impedance transmission line 30 of FIG. 3A. FIG. 7 shows a signal performance 72 of the exemplary impedance transmission line 30 of FIG. 3A configured as a 2 gigahertz (GHz) to 20 GHz Ruthroff type transformer and having the openings 48 in the second planar conductor 34. An insertion loss 74 for the exemplary impedance transmission line 30 is also shown. The insertion loss 74 is less than 1 decibel (dB) between 2 GHz and 20 GHz (e.g., 0.9722 dB at 2 GHz, 0.4317 dB at 4 GHz, 0.5384 dB at 18 GHz, and 0.575 dB at 20 GHz). Shaded regions 76, 78 indicate poorer performance of an impedance transmission line 30 where the openings 48 are omitted (e.g., due to less efficient mask cleanout under the second planar conductor 34).

Figure 8:
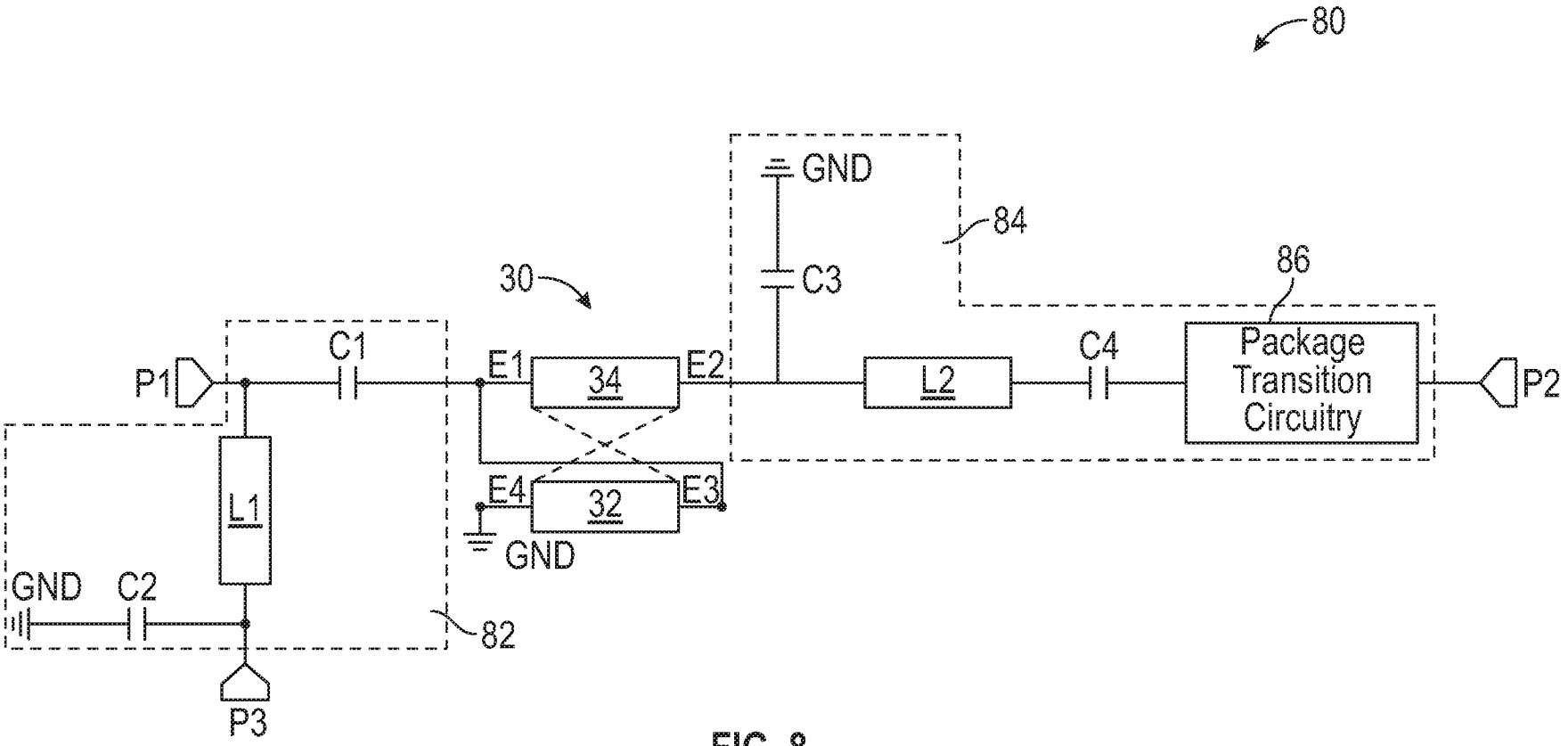
FIG. 8 is a schematic diagram of exemplary impedance transformation circuitry that includes the exemplary impedance transmission line of FIG. 3A.

FIG. 8 is a schematic diagram of exemplary impedance transformation circuitry 80 that includes the exemplary impedance transmission line 30 of FIG. 3A. The impedance transmission line 30 in FIG. 8 may be configured as a Ruthroff type transformer. The impedance transformation circuitry 80 has a first port P1 that accepts an RF signal input, a second port P2 that passes the RF signal to external components, and a third port P3 that is a bias injection port for an external amplifier that typically has an output coupled to the first port P1. An input matching circuit section 82 is coupled between the first port P1, a first end E1 of the second planar conductor 34, the third port P3 and ground GND. The input matching circuit section 82 extends the bandwidth of the impedance transformation circuitry 80 towards lower frequencies. Moreover, in at least one embodiment, the input matching circuit section 82 is configured as a bias tee. In at least one embodiment, the input matching circuit section 82 includes a first capacitor C1 coupled between the first port P1 and the first end E1 of the second planar conductor 34. A first inductor L1 is coupled between the first port P1 and the third port P3. A second capacitor C2 is coupled between the third port P3 and ground GND.

An output matching circuit section 84 is coupled between a second end E2 of the second planar conductor 34 and the second port P2. In at least one embodiment, the output matching circuit section 84 includes a third capacitor C3 coupled between the second end E2 of the second planar conductor 34 and ground GND. The output matching circuit section 84 further includes a second inductor L2 coupled in series with a fourth capacitor C4 between the second end E2 of the second planar conductor 34 and the second port P2. The output matching circuit section 84 also further includes package transition circuitry 86 configured to provide transition impedance that is tuned to reduce RF signal reflection and loss due to parasitic impedance of wire bonds within an external component package (not shown) coupled to the second port P2. An exemplary input impedance ($Z_{IN}$) of 12.5 ohms (Ω) is seen looking into the input port P1. Due to the Ruthroff configuration of the impedance transmission line 30 (electrically coupling a third end E3 of the first planar conductor 32 to the first end E1 of the second planar conductor 34 and electrically coupling a fourth end E4 of the first planar conductor 32 to ground GND, with crisscrossed dashed lines representing energy coupling between the first planar conductor 32 and the second planar conductor 34), an output impedance $Z_{OUT}$ is four times the input impedance $Z_{IN}$, which in this case results in $Z_{OUT}$ equal to 50Ω.

Figure 9:
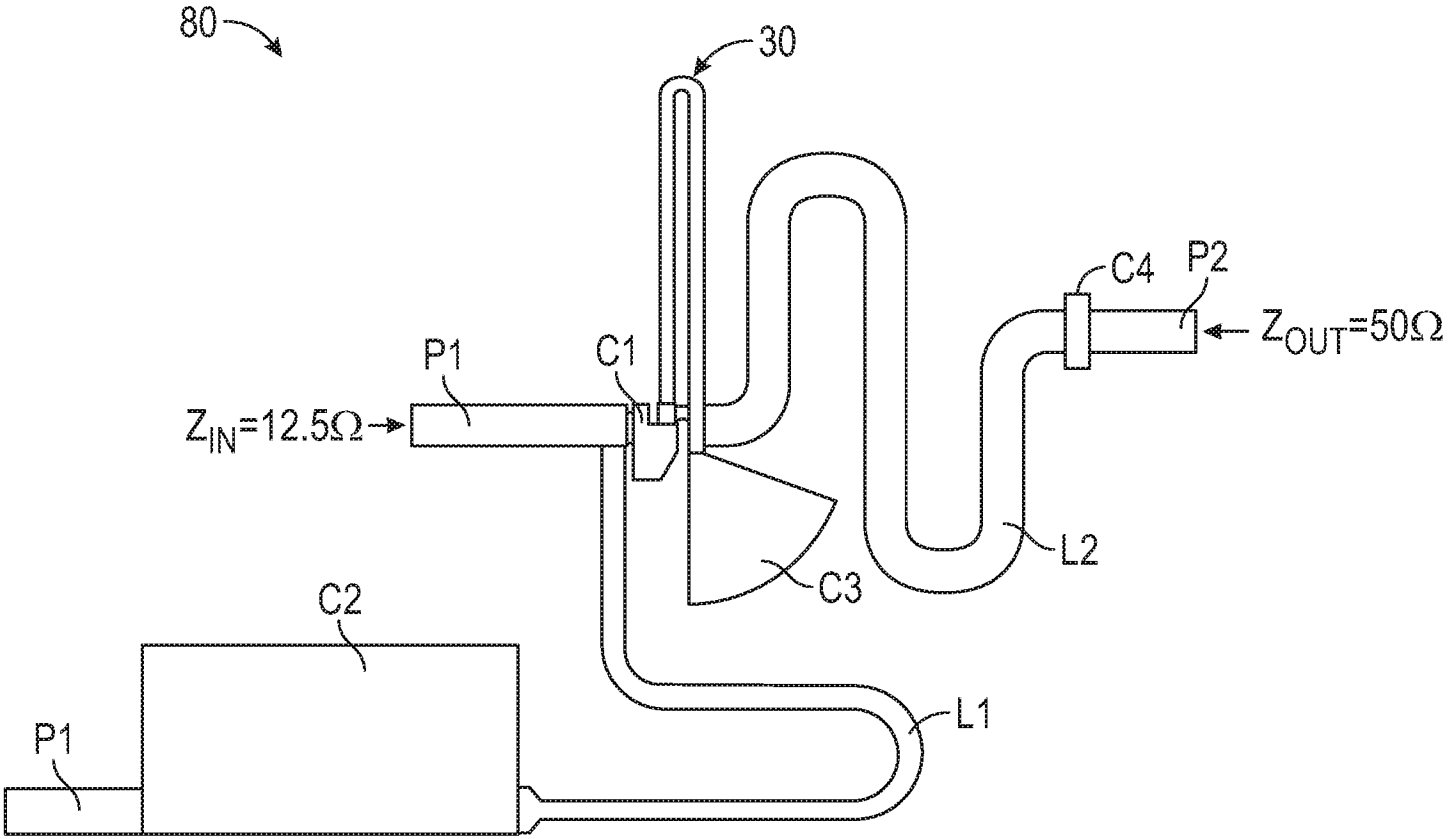
FIG. 9 is an exemplary monolithic transmission line type physical layout of the impedance transformation circuitry of FIG. 8.

FIG. 9 is an exemplary monolithic transmission line type physical layout of the impedance transformation circuitry 80 of FIG. 8. The physical layout implements a 60 μm wide shunt inductor microstrip for the first inductor L1 to provide greater than 1800 mA current handling. The exemplary physical layout for the impedance transformation circuitry 80 provides an operational bandwidth of 2-20 GHz.

As described above, in some examples the impedance transmission line 30 is configured differently than shown in FIGS. 3A-4. For example, FIGS. 10A, 10B and 11 depict another exemplary impedance transmission line 30 having one support post 38 spanning a continuous distance of the first edge 40 and another support post 38 spanning a continuous distance of the second edge 42.

Figure 10A:
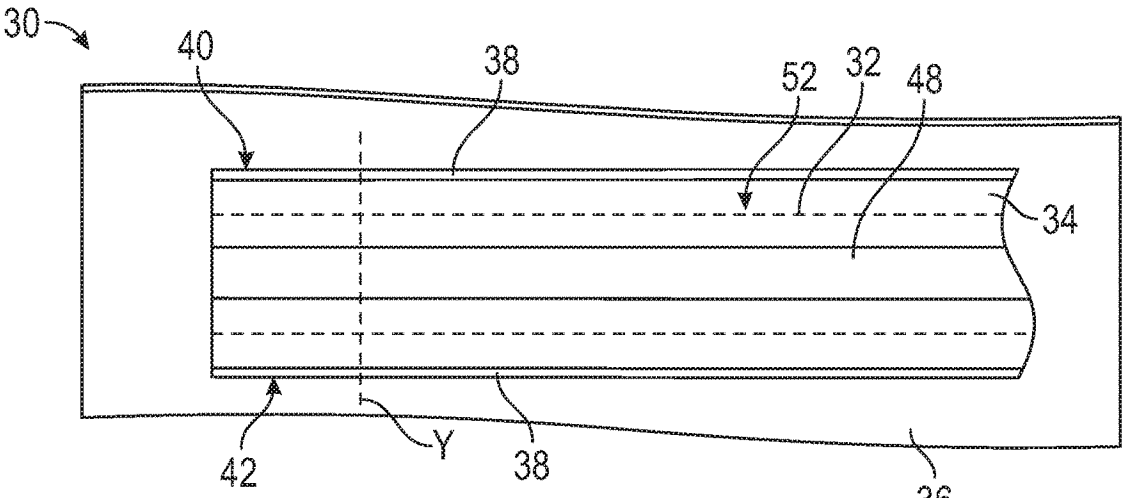
FIG. 10A is a topside view of another exemplary impedance transmission line.

In this regard, FIG. 10A is a topside view of the exemplary impedance transmission line 30. Similar to FIG. 3A, the impedance transmission line 30 includes a first planar conductor 32 disposed on a dielectric substrate 36 and a second planar conductor 34 positioned over and spaced apart from the first planar conductor 32 by support posts 38. The second planar conductor 34 has a first edge 40 and an opposite second edge 42. Each support post 38 couples the first edge 40 or the second edge 42 to the dielectric substrate 36. One support post 38 spans a continuous distance of the first edge 40 (e.g., along an entire length of the first edge 40) and another support post 38 spans a continuous distance of the second edge 42. Similar to FIG. 3A, the support posts 38 thermally couple the second planar conductor 34 to the dielectric substrate 36 to improve overall performance of the impedance transmission line 30.

Figure 10B:
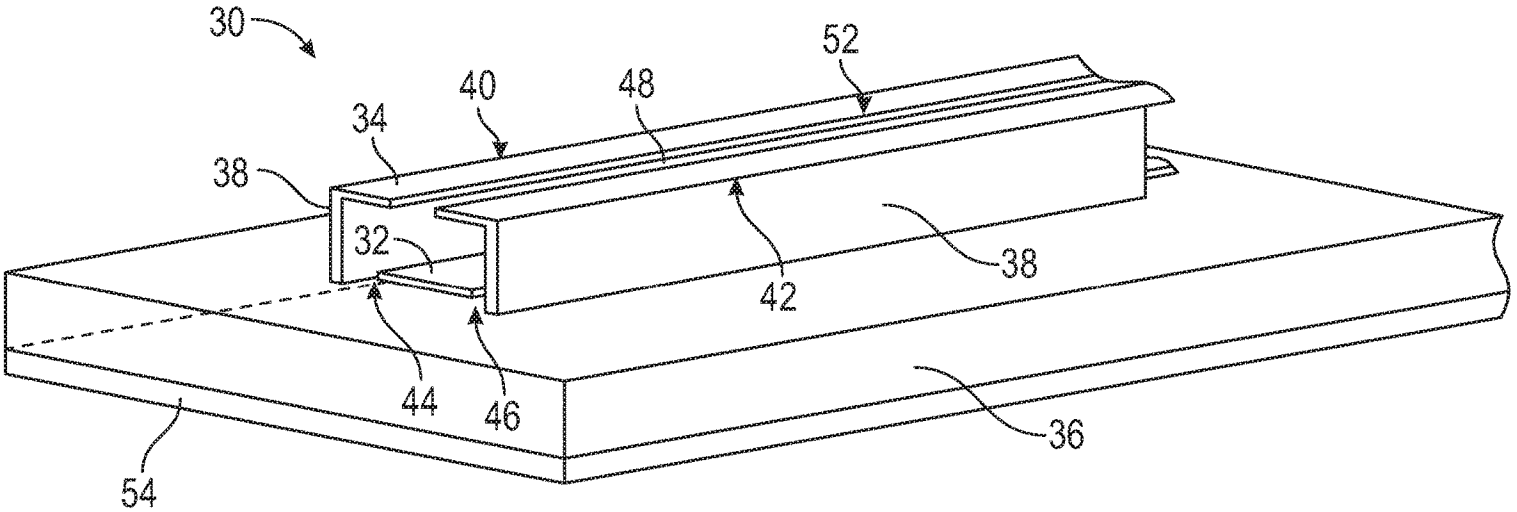
FIG. 10B is a perspective view of an end section of the impedance transmission line of FIG. 10A

FIG. 10B is a perspective view of an end section of the impedance transmission line 30 of FIG. 10A. In the exemplary embodiment depicted in FIGS. 10A and 10B, the second planar conductor 34 defines an opening 48 in its planar surface over the first planar conductor 32. The opening 48 also spans a continuous distance of the second planar conductor 34, defined parallel to the first edge 40 and the second edge 42.

Figure 11:
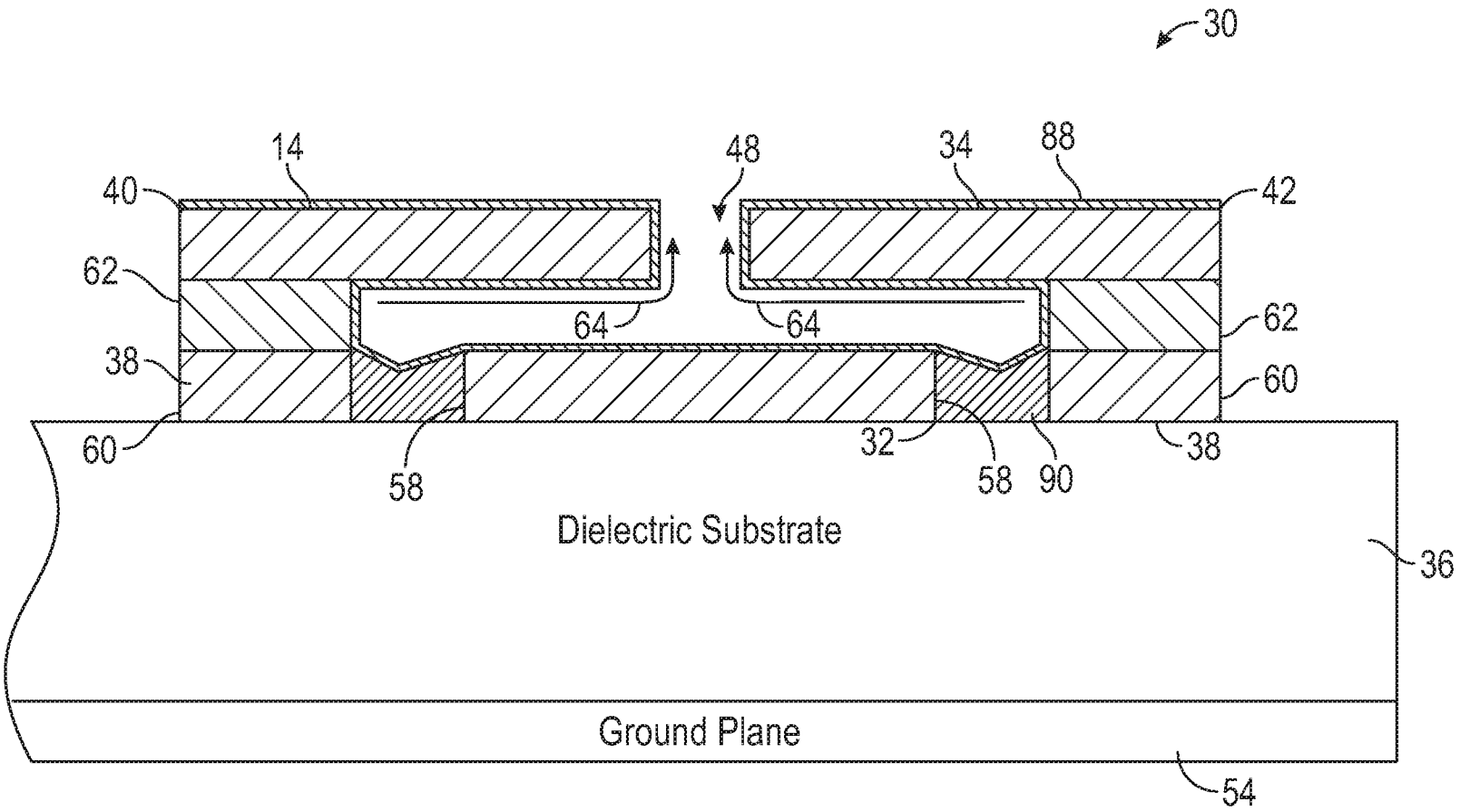
FIG. 11 is a cross-sectional view of the impedance transmission line of FIG. 10A taken along line Y.

FIG. 11 is a cross-sectional view of the impedance transmission line 30 of FIG. 10A taken along line Y. Similar to FIG. 4, the impedance transmission line 30 can be deposited on the dielectric substrate 36 through a multi-layer deposition technique. For example, the first planar conductor 32 and a bottom section 60 of the support posts 38 may be deposited in a first layer. A middle section 62 of the support posts 38 may be deposited in a second layer, and the second planar conductor 34 may be deposited in a third layer. In this regard, a mask, such as a photoresist layer, may be applied during the formation of the impedance transmission line 30, and the mask may be etched or otherwise cleaned out once the first planar conductor 32, the second planar conductor 34, and the support posts 38 are deposited. The opening 48 spanning the continuous distance of the second planar conductor 34 may facilitate etching the mask by allowing flow 64 of gases through the opening 48.

In an exemplary aspect, a protective overcoat 88 may be formed over some or all surfaces of the impedance transmission line 30. The protective overcoat 88 may be a dielectric layer having a thickness of 100 to 5000 angstroms (Å). The protective overcoat 88 may be deposited (e.g., through sputtering, vapor deposition, or another appropriate technique) after formation of the first planar conductor 32, the second planar conductor 34, and the support posts 38. The protective overcoat 88 may electrically insulate the metal surfaces of the impedance transmission line 30, provide environmental protection, and/or provide additional mechanical strength.

In addition, in some examples a dielectric material 90 may be deposited between the first planar conductor 32 and the support posts 38. The dielectric material 90 may be the same or a different material as the protective overcoat 88, and may be formed in the same or a different process. It should be understood that the protective overcoat 88 and/or the dielectric material 90 may be used in other embodiments, such as those described above with respect to FIGS. 3A-4.

Those skilled in the art will recognize improvements and modifications to the preferred embodiments of the present disclosure. All such improvements and modifications are considered within the scope of the concepts disclosed herein and the claims that follow.

What is claimed is:

1. An impedance transmission line, comprising:

a dielectric substrate;

a first planar conductor disposed on the dielectric substrate;

a second planar conductor positioned over and spaced apart from the first planar conductor, the second planar conductor having a first edge and a second edge opposite the first edge; and a plurality of support posts, each support post thermally coupling the first edge or the second edge of the second planar conductor to the dielectric substrate;

wherein each of the plurality of support posts has a width defined along the first edge or the second edge of the second planar conductor which exceeds any gap between adjacent support posts.

2. The impedance transmission line of claim 1, wherein the second planar conductor defines a plurality of openings in its planar surface over the first planar conductor.

3. The impedance transmission line of claim 2, wherein each of the plurality of openings is positioned along one of the plurality of support posts.

4. The impedance transmission line of claim 1, wherein space between the first planar conductor and the second planar conductor is filled with air.

5. The impedance transmission line of claim 1, wherein top and bottom surfaces of the second planar conductor are not in direct contact with a solid dielectric.

6. The impedance transmission line of claim 1, wherein the second planar conductor is oblong, having a first length of the first edge and a second length of the second edge of the second planar conductor exceed a width between the first edge and the second edge.

7. The impedance transmission line of claim 6, wherein the second planar conductor defines a plurality of oblong openings in its planar surface spanning parallel to the first edge and the second edge.

8. The impedance transmission line of claim 7, wherein each of the plurality of oblong openings is centered with one of the plurality of support posts.

9. The impedance transmission line of claim 1, wherein:

the plurality of support posts is coupled to the first edge; and an additional support post is coupled to the second edge.

10. The impedance transmission line of claim 9, wherein the additional support post spans a continuous distance of the second edge.

11. The impedance transmission line of claim 1, wherein:

the impedance transmission line comprises a transformer; and each of the first planar conductor and the second planar conductor are arranged over the dielectric substrate in an elongated U-shaped pattern, the first edge and the second edge being elongated edges of the elongated U-shaped pattern.

12. The impedance transmission line of claim 1, wherein the first planar conductor and the second planar conductor each have a thickness that is greater than 2 μm and less than 6 μm.

13. The impedance transmission line of claim 1, wherein the first planar conductor, the second planar conductor, and the plurality of support posts comprise at least one of gold or copper.

14. A method of forming an impedance transmission line, comprising:

forming a first planar conductor having a first edge and a second edge on a dielectric substrate;

forming a first set of support posts on the dielectric substrate along and separated from the first edge;

forming a second set of support posts on the dielectric substrate along and separated from the second edge; and forming a second planar conductor on the first and second sets of support posts, the second planar conductor defining a plurality of openings positioned between the first set of support posts and the second set of support posts.

15. The method of claim 14, further comprising applying a mask to the dielectric substrate before forming the first planar conductor.

16. The method of claim 15, further comprising etching the mask using the plurality of openings.

17. The method of claim 15, wherein the mask comprises a photoresist layer.

18. The method of claim 14, wherein each of the first set of support posts has a width defined along the first edge of the first planar conductor which exceeds any gap between adjacent support posts of the first set of support posts.

19. The method of claim 14, wherein forming the second planar conductor comprises forming the plurality of openings at regular intervals along a length of the second planar conductor parallel to the first edge and the second edge.

20. The method of claim 19, wherein each of the plurality of openings is oblong with an elongated length spanning along the length of the second planar conductor.

* * * * *